United States Patent [19]

Goldshtein et al.

[11] Patent Number: 4,767,045

[45] Date of Patent: Aug. 30, 1988

[54] HAND-HELD FASTENING ELEMENT DRIVING TOOL

[75] Inventors: Boris G. Goldshtein, Moscow; Vitaly T. Boiko, Khimki; Antanas-Sharunas A. Maljukyavichus, Vilnius; Alexandr V. Gaidukov; Valery I. Kovalenko, both of Khimki; Arkady A. Buravtsov; Vladimir A. Gordeev, both of Vilnius, all of U.S.S.R.

[73] Assignee: Nauchno-Proizvodstvennoe Obiedinenie PO Mekhanizrovannomu Stroitelnomu Instrumentu I Otdelochynym Mashinam, Moscow, U.S.S.R.

[21] Appl. No.: 563

[22] Filed: Jan. 5, 1987

[51] Int. Cl.[4] ..... B25C 1/04

[52] U.S. Cl. ..... 227/109; 227/120

[58] Field of Search ..... 227/109, 120

[56] References Cited

U.S. PATENT DOCUMENTS 3,633,811 1/1972 Ploen ..... 227/109

4,313,552 2/1982 Maurer ..... 227/109

4,375,867 3/1983 Novak et al. ..... 227/109

FOREIGN PATENT DOCUMENTS 2354740 5/1975 Fed. Rep. of Germany .

2511023 9/1975 Fed. Rep. of Germany .

3126536 1/1983 Fed. Rep. of Germany ..... 227/109

*Primary Examiner*—Paul A. Bell

*Attorney, Agent, or Firm*—McAulay, Fields, Fisher, Goldstein & Nissen

[57] ABSTRACT

A hand-held fastening element driving tool comprising a body accommodating a reciprocating actuator. The body carries a barrel wherein a striker is movable. The barrel holds a fastening element magazine. The striker consists of two parts closely fitted to each other. One part is a rectangular member whose cross-section follows the contour of a staple-shaped fastening element. The other member, together with the rectangular member, forms a figure circumscribing the head of a stem-shaped fastening element. The barrel cross-section is made as to suit the shape of the striker.

16 Claims, 2 Drawing Sheets

HAND-HELD FASTENING ELEMENT DRIVING TOOL

TECHNICAL FIELD

The herein proposed invention relates generally to the field of mechanical engineering and more specifically, to the hand-held fastening element driving tool.

BACKGROUND OF THE INVENTION

The herein proposed invention is practicable for driving nails and staples into wooden structures at the integrated house-building factories of the forestry and wood-working industries as well as for the manufacture of wooden panels for containers and packing cases.

During the impact operation of the driving tool, the most heavily loaded members, apart from the body, are the barrel and the striker. Therefore, special demands as to the quality of manufacture and design are placed on these members.

As a rule, the barrel and the striker, being mating parts, are made geometrically so as to suit other's cross-sectional shape, the determining factor for a hand-held nail driving tool being the shape of the nail head, and for a staple driving tool, the shape of the staple web.

Known in the present state of the art is a hand-held nail driving tool (cf., laid-open Application No. 2,511,023, Federal Republic of Germany, Int. Cl.$^3$ B25C 1/04) comprising a body with a barrel, a working cylinder with a striker, a shock-absorber and a magazine for loading the nails.

Such a tool is incapable of driving staples since the striker cross-section geometrically suits the shape of the nail head.

Besides, after machining and heat treatment, the striker needs additional straightening to make it truly straight, which renders it labour-concuming in manufacture.

Another staple and spike driving tool (cf., German Pat. No. 2,354,740, Int.Cl.$^3$ B25C 1/00) is known presently to comprise a body, a working cylinder with striker and shock-absorber, and a magazine for feeding the fastening elements (such as staples or spikes) to a guide channel of the barrel, which is constituted by the rear and front walls. The guide channel is rectangular in the cross-section so as to follow the shape of the staple web or the spike head.

The striker cross-sectional suits geometrically the shape of the staple web or the spike head. Therefore, it is unfeasible to use such a tool for driving nails.

Besides, the striker fails to afford the requisite rigidity, which renders it labour-consuming in manufacture.

SUMMARY OF THE INVENTION

It is a primary object of this invention to provide a hand-held tool for driving a variety of fastening elements.

It is another object of this invention to provide a hand-held tool for driving a variety of fastening elements, which is particularly adapted to the use of a striker of a simpler design.

The above-said object is accomplished due to the fact that in a hand-held fastening element driving tool comprising a body accommodating a reciprocating actuator made fast with a striker which is movable in a body-mounted barrel adapted to hold a fastening element magazine, according to the invention, the striker consists of two parts closely fitting each other, one of these being a rectangular member whose cross-section follows the contour of the staple-shaped fastening elements, whereas the other member, together with the rectangular member, forms a figure circumscribing the head of the stem-shaped fastening elements, the cross-section of said barrel is made as to suit the shape of the striker.

When designed in such a manner, the tool becomes universal, i.e., it is now practicable for driving fastening elements of virtually any shape, including nails, staples, spikes, etc.

The herein proposed striker provides the necessary rigidity, which renders it less labour-consuming in manufacture, since no additional straightening of the striker is required to make it truly straight.

BRIEF DESCRIPTION OF THE DRAWINGS

In what follows the present invention will now be disclosed in a detailed description of an illustrative embodiment thereof with reference to the accompanying drawings, wherein.

DETAILED DESCRIPTION OF THE INVENTION

Figure 1:
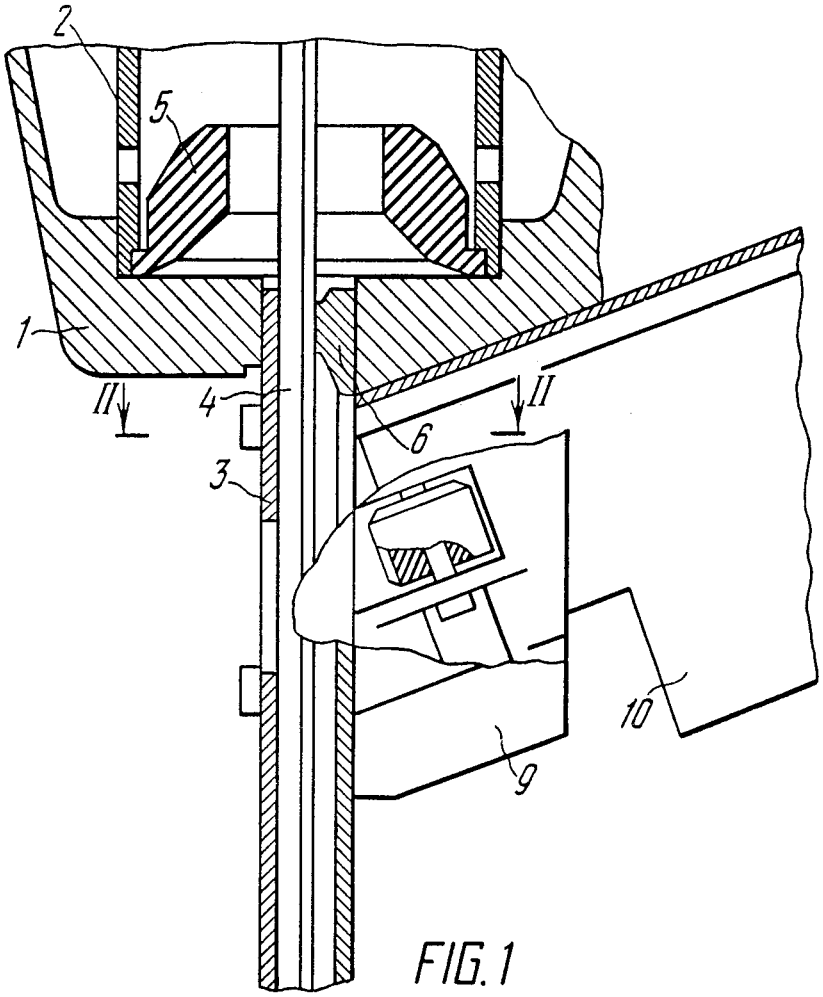
FIG. 1 is a longitudinal section of a hand-held fastening element driving tool, according to the invention.

A hand-held fastening element driving tool comprises a body 1 (FIG. 1) which accommodates a reciprocating actuator 2. The body 1 carries a barrel 3 in which a striker 4 is movably fitted. The actuator 2 is made fast to the striker 4 (not shown) and is provided with a shock-absorber 5.

The barrel 3 is connected to an intermediate plate 6. The barrel 3 and the intermediate plate 6 provide guidance for the striker 4 and form a channel as to suit the shape of the striker 4.

Figure 2:
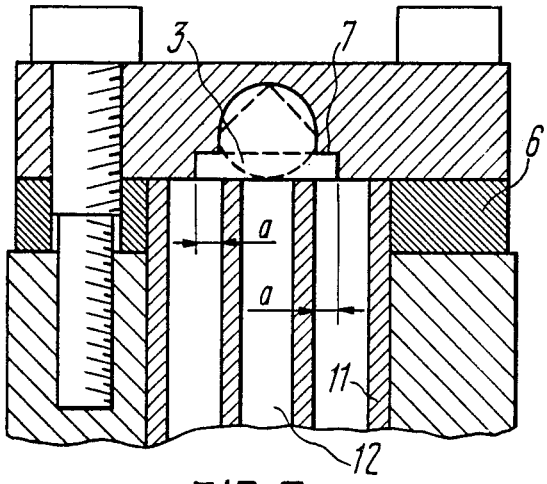
FIG. 2 is a section taken on the line II—II in FIG. 1.
Figure 3:
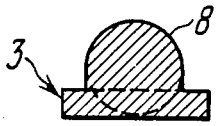
FIG. 3 is a cross-sectional view of an embodiment of the striker.
Figure 4:
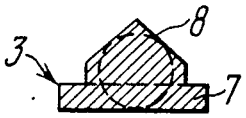
FIG. 4 is a cross-sectional view of an alternative embodiment of the striker.

The striker 4 consists of two parts fitted to each other, one of these being a rectangular member 7 (FIG. 2) whose cross-section follows the contour of the staple-shaped fastening element. The other member 8 (FIGS. 3,4), together with the rectangular member 7, forms a figure circumscribing the head of a stem-shaped fastening element, such as a circle (FIG. 3) or a polygon (FIG. 4).

The cross-section of the barrel 3 is intricately shaped so as to suit the shape of the striker: one portion thereof being rectangular to follow geometrically the shape of the staple web, whereas the other portion is profiled to circumscribe the head of a fastening element, e.g., a round head of a nail.

The body 1 (FIG. 1) of a hand-held fastening element driving machine provides a base 9 whereon a fastening element magazine 10 is installed. The fastening element magazine 10 offers guides 11 (FIG. 2) and an axial slot 12.

The guides 11 of the magazine 10 are fitted symmetrically with respect to the axis of the barrel 3 with a clearance "a" which corresponds to the thickness of the leg of a staple-shaped fastening element. The end faces of the guides 11 and the other member 8 of the striker 4 provide a space wherein the head of a stem-shaped fastening element can be easily fitted.

A hand-held fastening element driving tool operates as follows.

In the initial position, the striker 4 finds itself in the upper portion of the barrel 3. The channel of the barrel 3 is vacant to receive a fastening element.

The magazine 10 is loaded with a stack of the stem-shaped fastening elements and a stack of the staple-shaped fastening elements.

Whenever a step-shaped fastening element is to be used, this element is fed to the channel of the barrel 3 until the surface of the other member 8 of the striker 4 should circumscribe the head of a stem-shaped fastening element (a nail).

Upon actuating the tool, the striker 4 hits the nail on the head, whereby it is passed through the channel of the barrel 3 and is inserted into a wooden structure. After hitting the nail, the striker 4 returns to the initial position and the cycle is repeated.

Whenever a staple-shaped fastening element (a staple) is to be used, it is fed to the channel of the barrel 3, via the guides 11, until it should contact the rectangular member 7 of the striker 4.

Upon actuating the tool, the striker 4 hits the staple on the web, whereby it is freely passed through the rectangular portion of the channel of the barrel 3, which suits the rectangular member 7 of the striker 4, and is inserted into a wooden structure.

Thus the herein proposed tool provides a universal device applicable for driving the fastening elements of virtually any type.

The present invention provides a universal hand-held driving tool and simplifies the striker manufacture.

We claim:

1. A hand-held fastening element driving tool, for driving a variety of preselected fastening elements and in particular a stem-shaped element having a head-shaped element and a staple-shaped element having a web as selected from said preselected fastening elements for use with either the stemshaped element or the staple-shaped element, which comprises:

a body;

a reciprocating actuator accommodated in said body;

a barrel for feeding the fastening elements which is made fast to said body;

a magazine for holding the preselecting fastening elements, said magazine being attached to said barrel;

a striker for driving the preselected fastening elements, which is movable in said barrel and made fast with said actuator, said striker consisting of two parts closely fitted to each other;

one part of said striker being a rectangular member whose cross-section follows the contour of the web of said staple-shaped preselected fastening element;

the other part being a member, together with the rectangular member, forming a figure circumscribing the head of said stem-shaped preselected fastening element; and said barrel having a single inner channel with a cross-section and being made so as to suit the shape of the striker and the variety of fastening elements used.

2. The tool as claimed in claim 1 for driving said stem-shaped fastening element in the form of a nail having a round head, wherein said striker is movably fitted in said barrel and shaped to engage said round head while said barrel is configured to permit movement therein of said one part whose cross-section follows the contour of the staple web of said staple-shaped fastening element.

3. The tool as claimed in claim 2, including an intermediate plate connected to said barrel, said barrel and said intermediate plate together forming said channel having an inner circumferential configuration conforming to the outer circumferential shaped configuration of said striker to permit controlled movement of said outer circumferential shaped configuration within said inner circumferential configuration of the combined shape of said channel formed by said intermediate plate and said barrel with said striker having the shape to engage the head of said round headed nail as well as the staple web of said staple-shaped fastening element.

4. The tool as claimed in claim 1, including an intermediate plate connected to said barrel, said barrel and said intermediate plate forming said channel having an inner configuration to suit the shape of said striker.

5. The tool as claimed in claim 1, wherein said one part has a rectangular shape to engage the web of said staple-shaped element and said other part is shaped in the form of a polygonal configuration.

6. The tool as claimed in claim 5, wherein said polygonal-shaped other part is shaped in the form of a circle.

7. The tool as claimed in claim 1, wherein said magazine includes guides fitted symetrically with respect to the axis of said barrel and having a clearance corresponding to the legs of the staple-shaped fastening element.

8. The tool as claimed in claim 1, wherein said magazine includes a first load area for said stem-shaped fastening elements and a second load area for said staple-shaped fastening elements.

9. The tool as claimed in claim 8, wherein said magazine includes guides cooperating with said striker for feeding the staple-shaped fastening elements to said channel of said barrel until one part of said striker contacts said staple-shaped fastening element.

10. The tool as claimed in claim 8, including means for feeding said stem-shaped fastening elements to said channel until the surface of said other part circumscribes the head of said stem-shaped fastening element.

11. The tool as claimed in claim 1, wherein said channel includes a rectangular portion through which the web of said staple-shaped fastening element passes.

12. The tool as claimed in claim 1, wherein said channel includes a nail head shaped portion through which said stem-shaped fastening element passes.

13. The tool as claimed in claim 1, wherein said channel has an inner circumferential configuration to receive the head of said stem-shaped fastening element and permit it to pass therethrough and has a rectangularly-shaped portion configured to the web of said staple-shaped fastening element for permitting thereof to pass through said channel.

14. The tool as claimed in claim 1, including means for feeding said stem-shaped fastening elements to said channel until the surface of said other part circumscribes the head of said stem-shaped fastening element.

15. The tool as claimed in claim 14, wherein said magazine includes a first load area for said stem-shaped fastening elements and a second load area for said staple-shaped fastening elements.

16. The tool as claimed in claim 15, wherein said magazine includes guides cooperating with said striker for feeding the staple-shaped fastening elements to said channel of said barrel until one part of said striker contacts said staple-shaped fastening element.

* * * * *